US009217357B2

(12) United States Patent
Latham et al.

(10) Patent No.: US 9,217,357 B2
(45) **Date of Patent: *Dec. 22, 2015**

(54) METHOD OF PRODUCING AN INSULATED EXHAUST DEVICE

(76) Inventors: Ruth Latham, Ann Arbor, MI (US); William Alcini, Ann Arbor, MI (US); Steven Freis, Ann Arbor, MI (US)

( * ) Notice: Subject to any disclaimer, the term of this patent is extended or adjusted under 35 U.S.C. 154(b) by 759 days.

This patent is subject to a terminal disclaimer.

(21) Appl. No.: 13/277,663

(22) Filed: Oct. 20, 2011

(65) Prior Publication Data

US 2013/0097839 A1 Apr. 25, 2013

(51) Int. Cl.
*F01N 13/18* (2010.01)
*F01N 13/14* (2010.01)

(52) U.S. Cl.
CPC ..... *F01N 13/14* (2013.01); *F01N 13/148* (2013.01); *F01N 13/18* (2013.01); *F01N 2310/02* (2013.01); *Y10T 29/49826* (2015.01)

(58) Field of Classification Search
CPC ..... F01N 13/18; F01N 13/14; F01N 13/141; F01N 13/148; F01N 13/102; Y10T 29/49345; Y10T 29/49398
USPC ..... 29/890.08, 890
See application file for complete search history.

(56) References Cited

U.S. PATENT DOCUMENTS 4,428,999 A 1/1984 George et al.
7,033,412 B2 * 4/2006 Kumar et al. ..... 55/523
2002/0134484 A1 9/2002 Erb, Jr.
2004/0134172 A1 7/2004 Kumar et al.
2011/0088805 A1 * 4/2011 Nakagawa ..... 138/140
2011/0185575 A1 8/2011 Olivier et al.

FOREIGN PATENT DOCUMENTS

JP 2006-501402 A1 1/2006

OTHER PUBLICATIONS

International Search Report and Written Opinion dated Nov. 5, 2012.
English Translation of Japanese Office Action dated Nov. 26, 2013 for Japanese Patent Application No. 2012-551142.

* cited by examiner

*Primary Examiner* — Christopher Besler
(74) *Attorney, Agent, or Firm* — Wood, Phillips, Katz, Clark & Mortimer

(57) ABSTRACT

A method is provided for producing an exhaust gas aftertreatment or acoustic device (20) having a maximum operating temperature $T_{MAX}$. The method includes the steps of providing a blanket (40) of silica fiber or alumina insulation material having a weight percentage of $SiO_2$ or $Al_2O_3$ of greater than 65%; calcining the insulating material by heating the blanket (40) so that all of silica fiber insulation material is raised to a temperature T greater than $T_{MAX}$; and securing the blanket (40) on the device (20) after the calcining step. The blanket is encapsulated in a covering prior to the securing step, and before or after the calcining step, with the covering between the blanket and the device being a selected one of foil, wire mesh, or siliconized fiber glass.

8 Claims, 1 Drawing Sheet

METHOD OF PRODUCING AN INSULATED EXHAUST DEVICE

CROSS-REFERENCE TO RELATED APPLICATIONS

Not applicable.

FEDERALLY SPONSORED RESEARCH OR DEVELOPMENT

Not Applicable.

MICROFICHE/COPYRIGHT REFERENCE

Not Applicable.

FIELD OF THE INVENTION

This invention relates to exhaust gas aftertreatment and/or acoustic systems and the devices used therein that utilize external insulation blankets.

BACKGROUND OF THE INVENTION

Heat insulating batts and blankets are utilized in exhaust gas systems in order to provide heat insulation for acoustic and aftertreatment devices of the system to control the heat exchange to and from the devices. It is known, for example, to place heat insulating blankets between adjacent wall surfaces of such devices with the material of the heat insulation blanket being compressed to provide a desired installed density for the material to help maintain the heat insulating blanket in its mounted position via frictional forces between the blanket and the adjacent wall surfaces. Such a structure is shown in U.S. Ser. No. 12/696,347, filed Jan. 29, 2010 by Keith Olivier et al., entitled "Method of Producing an Insulated Exhaust Device", the disclosure of which is hereby incorporated by reference.

It is also known to provide heat insulation blankets around the exterior of such exhaust gas system devices. However, such blankets have been found to encounter a variety of failure modes, including damage and cracking when removing and replacing insulation, damage due to exposure to vibration, damage due to loose or otherwise inappropriate fit due to thermal set, loss of insulation properties due to loose or otherwise inappropriate fit, and/or loss of insulation material.

The present invention is directed to overcoming one or more of the problems set forth above.

SUMMARY OF THE INVENTION

In one aspect of the present invention, a method of providing external insulation for an exhaust gas aftertreatment or acoustic device having a maximum operating temperature $T_{MAX}$ is provided, where the method includes (a) providing a blanket of silica fiber insulation material having a weight percentage of $SiO_2$ of greater than 65%, (b) calcining the blanket by heating all of silica fiber insulation material to a temperature T between $T_{MAX}$, wherein T is less than the melting temperature of the silica fibers of the blanket; and (c) securing the blanket around the device after the calcining step.

In one form of this aspect of the invention, T is at least $1.05 \times T_{MAX}$.

In another form of this aspect of the invention, the method further includes encapsulating the blanket in a covering after the calcining step and prior to the securing step whereby the blanket is batting in the covering, wherein the covering between the blanket and the device is a selected one of foil, wire mesh, or high temperature textile. In a further form, the high temperature textile is a selected one of siliconized fiber glass or straight woven glass fiber. In another form, the blanket is encapsulated in a covering before the calcining step.

In yet another form of this aspect of the present invention, during the calcining step the blanket is an uncompressed state.

In another form of this aspect of the present invention, $T_{MAX}$ is within the range of 300° C. to 1100° C.

In still another form, the securing step comprises installing the blanket so that the blanket encircles a core of the device through which the exhaust gas passes.

In yet another form, the silica fiber insulation material has a weight percentage of $SiO_2$ of greater than 95%.

In another aspect of the present invention, a method of producing an exhaust gas aftertreatment or acoustic device having a maximum operating temperature $T_{MAX}$ is provided, where the method includes (a) providing a blanket of alumina insulation material having a weight percentage of $Al_2O_3$ of greater than 65%, (b) calcining the blanket by heating the alumina to a temperature T greater than $T_{MAX}$, wherein T is less than the melting temperature of the alumina insulation material of the blanket, and (c) securing the blanket around the device after the calcining step.

In one form of this aspect of the invention, the method further includes encapsulating the blanket in a covering after the calcining step and prior to the securing step whereby the blanket is batting in the covering, wherein the covering between the blanket and the device is a selected one of foil, wire mesh, or high temperature textile. In a further form, the high temperature textile is a selected one of siliconized fiber glass or straight woven glass fiber. In another form, the blanket is encapsulated in a covering before the calcining step.

In still another form, the alumina insulation material has a weight percentage of $Al_2O_3$ of greater than 95%.

Other objects, features, and advantages of the invention will become apparent from a review of the entire specification, including the appended claims and drawings.

DETAILED DESCRIPTION OF THE PREFERRED EMBODIMENT

The present invention may be used, for example, in an exhaust gas system such as a diesel exhaust gas aftertreatment system to treat the exhaust from a diesel combustion process (e.g., a diesel compression engine). The exhaust will typically contain oxides of nitrogen ($NO_x$) such as nitric oxide (NO) and nitrogen dioxide ($NO_2$) among others, particulate matter (PM), hydrocarbons, carbon monoxide (CO), and other combustion by-products. The system may include one or more exhaust gas acoustic and/or aftertreatment devices or components. Examples of such devices include catalytic converters, diesel oxidation catalysts, diesel particulate filters, gas particulate filters, lean $NO_x$ traps, selective catalytic reduction monoliths, burners, manifolds, connecting pipes, mufflers, resonators, tail pipes, emission control system enclosure boxes, insulation rings, insulated end cones, insulated end caps, insulated inlet pipes, and insulated outlet pipes, all of any cross-sectional geometry, many of which are known.

As those skilled in the art will appreciate, some of the foregoing devices may be strictly metallic components with a central core through which the exhaust flows, and other of the devices may include a core in the form of a ceramic monolithic structure and/or a woven metal structure through which the exhaust flows. These devices are conventionally used in motor vehicles (diesel or gasoline), construction equipment, locomotive engine applications (diesel or gasoline), marine engine applications (diesel or gasoline), small internal combustion engines (diesel or gasoline), and stationary power generation (diesel or gasoline).

Figure 1:
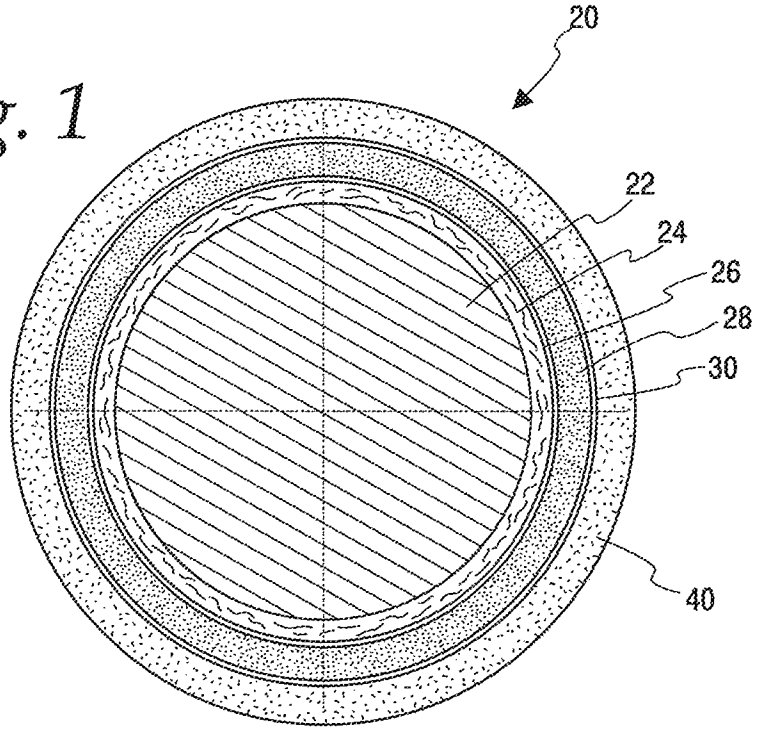
FIG. 1 is a section view of an exhaust system component employing the invention.

FIG. 1 shows one example of such a device for use in a system such as described above, in the form of a catalytic unit 20 such as shown in Olivier et al. U.S. Ser. No. 12/696,347, the disclosure of which was heretofore incorporated by reference.

The catalytic unit 20 has a catalytic core 22, a mount mat 24, a cylindrical inner housing or can 26, and heat insulating blanket or batt 28, and a cylindrical outer housing or jacket 30.

The core 22 may typically be a ceramic substrate having a monolithic structure with a catalyst coated thereon and will typically have an oval or circular cross section.

The mounting mat 24 is sandwiched between the core 22 and the can 26 to help protect the core 22 from shock and vibrational forces that can be transmitted from the can 26 to the core 22. Typically the mounting mat 24 is made of a heat resistant and shock absorbing-type material, such as a mat of glass fibers or rock wool and is compressed between the can and the carrier in order to generate a desired holding force.

The heat insulating blanket 28 located inside the catalytic unit outer housing 30 may be made of a silica fiber insulation material having a weight percentage of $SiO_2$ of greater than 65%, and in preferred embodiments greater than 95%, and in highly preferred embodiments greater than 98%. Such material is known and commercially available, with one suitable example being supplied by BGF Industries, Inc. under the trade name SilcoSoft®, and another suitable example being supplied by ASGLAWO technofibre GmbH under the trade name Asglasil®. Such material is typically supplied in rolls, with the individual blankets 28 being die cut to the appropriate length and width for the corresponding device 18 after the material has been taken from the roll.

In accordance with the present invention, an external blanket 40 is wrapped around the unit outer housing 30 so as to substantially encapsulate the housing 30.

In one embodiment, the external blanket 40 may be advantageously made of a silica fiber insulation material having a weight percentage of $SiO_2$ of greater than 65%, and in preferred embodiments greater than 95%, and in highly preferred embodiments greater than 98%. Such material is known and commercially available, with one suitable example being supplied by BGF Industries, Inc. under the trade name SilcoSoft®, and another suitable example being supplied by ASGLAWO technofibre GmbH under the trade name Asglasil®. Such material is typically supplied in rolls, with the individual blankets 40 being die cut to the appropriate length and width for the corresponding device 20 after the material has been taken from the roll. In one preferred form, the blanket 40 may have an average installed density of 0.18 grams/cubic centimeter to 0.30 grams/cubic centimeter of the silica fiber insulation material of the blanket 40.

According to the invention, before the blanket 40 is installed into the device 18, the blanket 28 is heat treated to achieve calcination of the silica fiber insulation material. In this regard, the blanket 40 is heated so that all of the silica fiber insulation material in the blanket 28 is raised to a temperature T greater than the maximum operating temperature $T_{MAX}$ of the device 20. This heat treatment improves the resiliency and erosion resistance of the silica fiber insulation material and also eliminates the potential for a "thermoset" failure mode that can result if the silica fiber material were calcinated in-situ in the device 20 during operation of the system. Preferably, this heat treatment takes place with the blanket 40 in an uncompressed or free state wherein there are no compressive forces being applied to the silica fiber insulation material of the blanket 40. The temperature T preferably has some margin of safety above the maximum operating temperature $T_{MAX}$ of the device 18, with one preferred margin of safety being $1.05 \times T_{MAX}$.

This heat treatment improves the resiliency and erosion resistance of the silica fiber insulation material and also eliminates the potential for a "thermoset" failure mode that could result if the silica fiber material were to be calcinated in-situ on the device during operation of the system. Preferably, such heat treatment takes place with the external blanket 40 in an uncompressed or free state wherein there are no compressive forces being applied to the silica fiber insulation material of the external blanket 40. The temperature T preferably has some margin of safety above the maximum operating temperature $T_{MAX}$ of the device 18, with one preferred margin of safety being $1.05 \times T_{MAX}$.

By heat treating the silica fiber heat insulation material to the temperature T greater than $T_{MAX}$ before the external blanket 40 is installed on the device, the heat treated blanket can maintain suitable frictional engagement with the unit outer housing 30 over the desired life of the device because the silica fiber insulation material of the blanket 40 maintains its resiliency and does not take on a "thermoset" from the max operation temperature $T_{MAX}$ of the device.

The heat treatment may advantageously be accomplished using an in-line oven wherein the silica fiber heat insulation material is unrolled from a supply roll of the material and passed flat through an oven on a conveyor so that the external blanket 40 is planar during the heat treatment to reduce or prevent differential heating of the material of the blanket 40 and variation in thickness of the material in the blanket 40. After heat treatment, individual blankets 40 can be die cut to the desired length and width before installing on a device. Alternatively, however, a complete supply roll of the silica fiber heat insulation material can be heat treated, with or without rotation of the roll in an oven, whereby individual blankets 40 can be die cut to the desired length and width after heat treatment and before installing on the device. As yet an another alternative, the silica fiber insulation material can be die cut before heat treatment, with the blanket being slightly oversized in length and width to account for shrinkage during heat treatment, and with the die cut blankets then heat treated in an oven while laying flat on a planar surface.

In accordance with a second embodiment, the external blanket 40 may also advantageously be a high alumina blanket. In one embodiment, the external blanket 40 may be advantageously made of an alumina insulation material having a weight percentage of $Al_2O_3$ of greater than 65%, and in preferred embodiments greater than 95%, and in highly preferred embodiments greater than 98%. Such blankets are known and commercially available, with one suitable example being supplied by Saffil Ltd. of Cheshire, U.K. under the LDM trade name, and another suitable example being supplied by Mitsubishi under the MLS-2 trade name. In accordance with the present invention, these high alumina blankets 40 are also heat treated to achieve calcination prior to placement on the device 20.

Figure 2:
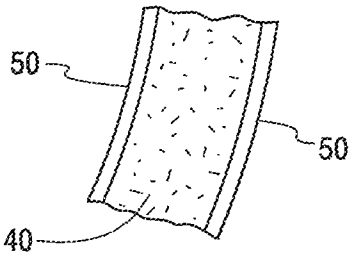
FIG. 2 is a section view of a portion of the external blanket of the present invention encapsulated in a covering.

The calcined external blanket 40 of either embodiment is advantageously used as batting encapsulated in a covering 50 prior to placement on the device 20, as illustrated in FIG. 2. Calcination of the blanket 40 may be accomplished before encapsulating the blanket 40 in the covering 50. However, calcination may also be accomplished in the covering 50 where the covering 50 will not be adversely impacted by the temperatures used in the calcinations. When installed on the device 20, the side of the covering facing the heat side (e.g., the device 20) may advantageously be foil, wire mesh or a high temperature textile, such as siliconized fiber glass or straight woven glass fiber.

It should be appreciated that devices in exhaust gas systems having external blankets according to the present invention substantially reduce damage and cracking when removing and replacing insulation, damage due to exposure to vibration, damage due to loose or otherwise inappropriate fit due to thermal set, and/or loss of insulation properties due to loose or otherwise inappropriate fit, and/or loss of insulation material.

It should also be appreciated that while the invention has been described herein in connection with a diesel combustion process in the form of, for example, a diesel compression engine, the invention may find use in devices that are utilized in exhaust gas systems for other types of combustion processes, including other types of internal combustion engines, including, for example, internal combustion engines that use gasoline or other alternative fuels.

The invention claimed is:

1. A method of providing external insulation for an exhaust gas aftertreatment or acoustic device having a maximum operating temperature $T_{MAX}$, the method comprising:

providing a blanket of silica fiber insulation material having a weight percentage of $SiO_2$ of greater than 65%;

calcining the blanket by heating all of the silica fiber insulation material to a temperature T greater than $T_{MAX}$, wherein T is less than a melting temperature of the silica fibers of the blanket;

securing the blanket around an outermost surface of the exhaust gas aftertreatment or acoustic device after the calcining step; and encapsulating said blanket in a covering after the calcining step and prior to the securing step whereby said blanket is batting in said covering, wherein said covering between said blanket and said exhaust gas aftertreatment or acoustic device is a selected one of wire mesh or high temperature textile.

2. The method of claim 1 wherein T is at least $1.05 \times T_{MAX}$.

3. The method of claim 1, wherein said high temperature textile is a selected one of siliconized fiber glass or straight woven glass fiber.

4. The method of claim 1 wherein during the calcining step the blanket is in an uncompressed state.

5. The method of claim 1 wherein $T_{MAX}$ is within the range of 300° C. to 1100° C.

6. A method of providing external insulation for an exhaust gas aftertreatment or acoustic device having a maximum operating temperature $T_{MAX}$, the method comprising:

providing a blanket of silica fiber insulation material having a weight percentage of $SiO_2$ of greater than 95%;

calcining the blanket by heating all of the silica fiber insulation material to a temperature T greater than $T_{MAX}$, wherein T is less than a melting temperature of the silica fibers of the blanket;

securing the blanket around an outermost surface of the exhaust gas aftertreatment or acoustic device after the calcining step; and encapsulating said blanket in a covering after the calcining step and prior to the securing step whereby said blanket is batting in said covering, wherein said covering between said blanket and said exhaust gas aftertreatment or acoustic device is a selected one of wire mesh or high temperature textile.

7. A method of providing external insulation of ran exhaust gas after treatment or acoustic device having a maximum operating temperature $T_{MAX}$, the method comprising:

providing a blanket of silica fiber insulation material having a weight percentage of $SiO_2$ of greater than 65%;

calcining the blanket in an uncompressed state by heating all of the silica fiber insulation material to a temperature T greater than $T_{MAX}$, wherein T is less than a melting temperature of the silica fibers of the blanket and is at least $1.05 \times T_{MAX}$ and $T_{MAX}$ is within a range of 300° C. to 1100° C.;

encapsulating said blanket in a covering after the calcining step whereby said blanket is batting in said covering; and securing the blanket around an outermost surface of the exhaust gas aftertreatment or acoustic device after the encapsulating step;

wherein said covering between said blanket and said exhaust gas aftertreatment or acoustic device is a selected one of wire mesh or high temperature textile.

8. The method of claim 7, wherein said high temperature textile is a selected one of siliconized fiber glass or straight woven glass fiber.

* * * * *